United States Patent [19]

Nilsson

[11] 3,973,736

[45] Aug. 10, 1976

[54] SYSTEM FOR ASSORTING SOLID WASTE MATERIAL AND PREPARATION OF SAME FOR RECOVERY

[75] Inventor: Claes Torsten Nilsson, Loddekopinge, Sweden

[73] Assignee: Aktiebolaget Platmanufaktur, Malmo, Sweden

[22] Filed: July 31, 1974

[21] Appl. No.: 493,222

[30] Foreign Application Priority Data

Aug. 9, 1973 Sweden ..... 7310899

[52] U.S. Cl. ..... 241/76; 209/12; 209/3; 209/39; 241/77; 241/DIG. 38

[51] Int. Cl.[2] ..... B02C 23/14

[58] Field of Search ..... 209/12, 214, 38–40, 209/223 R, 223 A, 218, 3; 241/76, 77, DIG. 38, 20, 24

[56] References Cited

UNITED STATES PATENTS

| | | | |
|---|---|---|---|
| 1,290,895 | 1/1919 | Bryan | 209/12 |
| 1,380,871 | 6/1921 | Swart | 209/223 A |
| 1,512,870 | 10/1924 | Ullrich | 209/214 |
| 2,151,894 | 3/1939 | Cambessedes | 209/12 |
| 2,943,930 | 7/1960 | Proler | 241/DIG. 38 |
| 2,971,703 | 2/1961 | Ruth | 241/76 X |
| 3,357,380 | 12/1967 | Siracusa | 241/DIG. 38 |
| 3,467,594 | 9/1969 | Musschout | 209/12 X |
| 3,477,649 | 11/1969 | Dalberg | 241/DIG. 38 |
| 3,524,594 | 8/1970 | Anderson | 241/DIG. 38 |
| 3,720,380 | 3/1973 | Marsh | 241/DIG. 38 |
| 3,725,538 | 4/1973 | Brewer | 209/12 X |
| 3,802,631 | 4/1974 | Boyd | 241/DIG. 38 |
| 3,836,085 | 9/1974 | Brown | 209/3 X |

*Primary Examiner*—Robert Halper
*Attorney, Agent, or Firm*—Hane, Baxley & Spiecens

[57] ABSTRACT

A device for recovering salvagable components from a mixture of compacted solid waste, especially municipal waste, which includes ferrous metals, non-ferrous metals such as aluminum, fibrous organic and inorganic materials. In this installation the solid waste, preferably after first breaking it up, is fed to a magnet assembly for dividing the components into ferrous metals and non-ferrous materials including ferrous metals and non-ferrous metals and organic or inorganic materials. The ferrous metals and the non-ferrous materials containing ferrous metals are then subjected to fragmentation after separating ferrous metals parts from non-ferrous materials. The resulting fragments are separated into ferrous metals and non-ferrous materials and separately conveyed to collection stations. Similarly, the non-ferrous metals and the organic or inorganic materials are first fragmented, then separated from each other and finally separately conveyed to collecting stations.

4 Claims, 2 Drawing Figures

SYSTEM FOR ASSORTING SOLID WASTE MATERIAL AND PREPARATION OF SAME FOR RECOVERY

It has become more and more obvious within the industrialized part of the world that in view of the depletion of the supply of raw materials and the rapidly increasing quantities of refuse, it is necessary to recover as much as possible of the material that has hitherto been regarded as waste. In many places in the world endeavours are therefore being made to develop facilities and systems for economical and efficient recovery of domestic and industrial waste. Great difficulties have been encountered, particularly due to the complex composition of the waste, and it has been found to be very difficult to solve the problems, with respect to both the technique and the economy.

The present invention, which relates to a system of machinery for handling e.g. domestic waste, efficiently solves problems concerned with the dividing up or sorting of the waste into groups of material that logically and in an economic way are appropriate for collecting, and processing the waste in such a way as to facilitate a profitable and technically correct recovery of the material, to a great extent.

Figure 1:
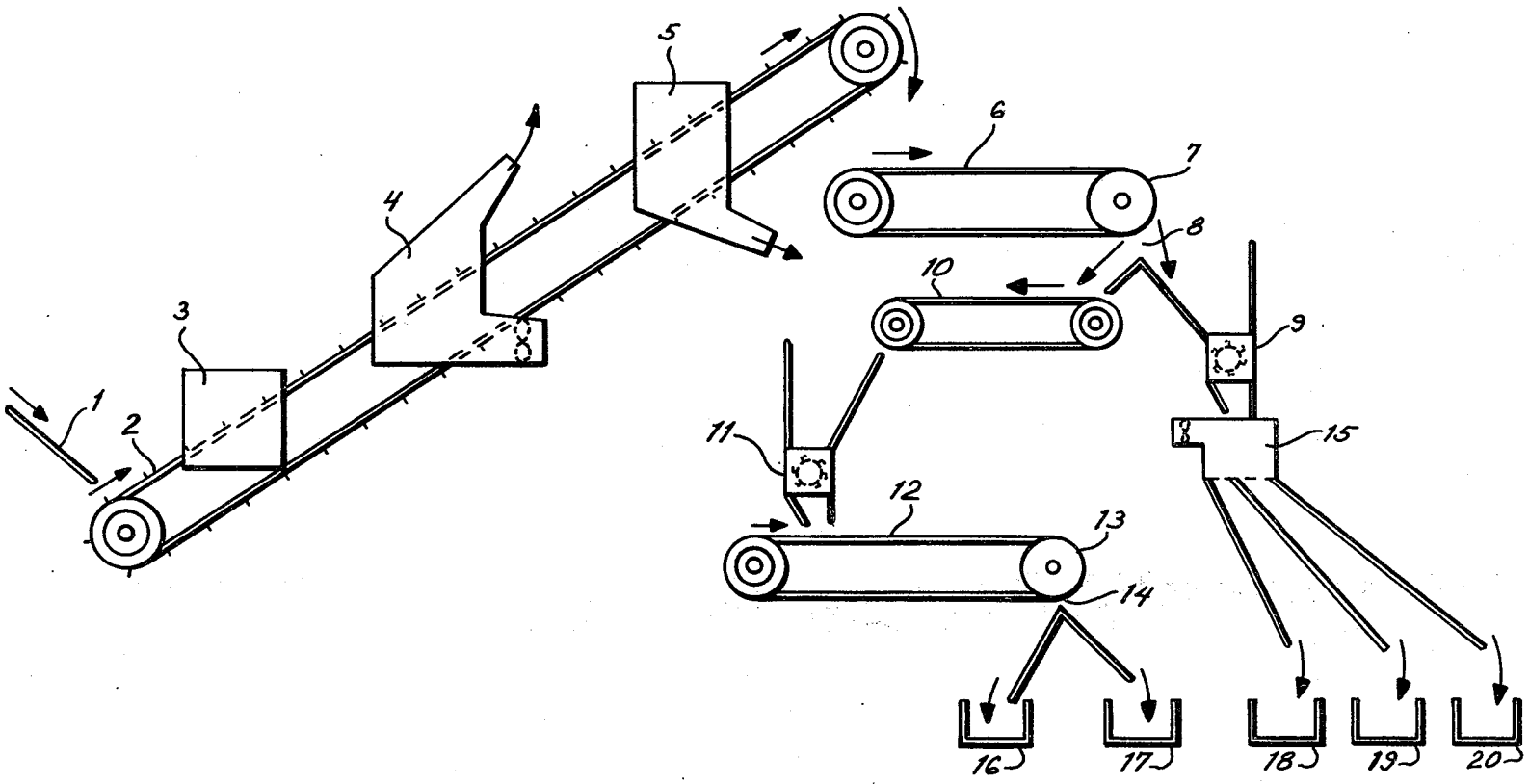
FIG. 1 is a diagram showing preliminary pretreatment steps prior to a magnetic separation and grinding treatment.

The invention will be described in the following, with reference to the attached figures. FIG. 1 is a schematic drawing of the system of machinery. Via a feeding device 1, the waste is conveyed to a conveyor 2. The conveyor 2 leads through a disintegrator unit 3, the purpose of which is to tear or pull apart long-fibred organic material, e.g. paper or plastic. The waste which has been separated or disintegrated in this way is conveyed by the conveyor 2 on to a separating station 4, where the long-fibred organic material of chiefly paper and plastic is blown away with air.

The conveyor 2 feeds the remaining, heavier solid waste on to a washing station 5, where lighter, chiefly organic waste is washed away. The remaining waste products, which now mainly consist of metal and glass waste, are fed by the conveyor 2 on to the conveyor 6, and by this conveyor over to a magnetic drum 7, which separates the magnetic material from the non-magnetic material over a divider 8, which is located in such a way that the freely falling non-magnetic material is conveyed directly to a mill, where it is fragmented. The non-magnetic material which has been disintegrated in the way described is conveyed from the mill 9 through a separating station 15, where the various fragments of material are divided up through air separation according to their different specific gravity. As examples of the materials that are collected here, in the containers 18, 19 and 20, may be mentioned glass, aluminium and organic material.

The magnetic material which is separated with the aid of the magnetic drum 7 is conveyed via the dividers 8 and by the conveyor 10 to a mill 11, where it is fragmented. By the fragmentation or disintegration which takes place, e.g. such non-magnetic material as has been comprised as a component in a tin can is released. From the mill 11, the fragmented material is fed on to the conveyor 12, and the magnetic material is separated from the released non-magnetic material with the aid of the magnetic drum 13, and conveyed to different collecting containers 16 and 17, of which the container 16 will contain magnetic material and the container 17 will contain non-magnetic material.

Figure 2:
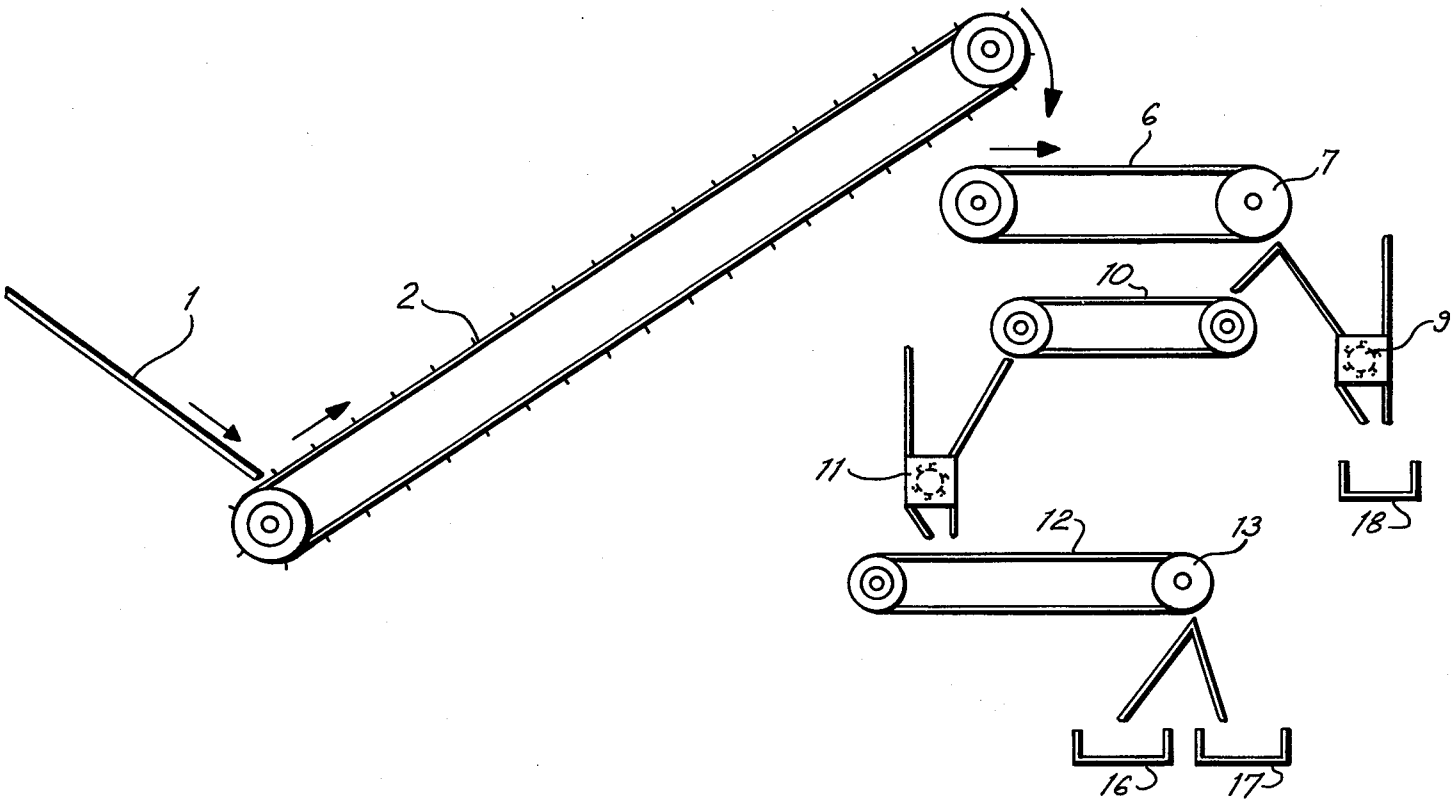
FIG. 2 is a modification showing a conveying of the waste material to a magnetic separation and grinding treatment absent the preliminary treatment.

Successful drives for collecting used plate and glass packaging are being conducted in various places in the country. Thus, by the contributions from the consumers, a first sorting of the domestic waste is achieved. For efficient handling of the collected plate and glass packaging, a simplified version of the plant described above has been developed. This invention, which is based entirely upon the system of machinery described in the foregoing, is shown schematically in FIG. 2, and will be explained in the following.

The mixed plate such as dinnerware made of plastic and glass waste batch or package is fed via the feeding trough or feeding device 1 to the conveyor 2, from where it is conveyed to the conveyor 6, where the magnetic plate packaging is separated from the non-magnetic glass packaging with the aid of the magnetic drum 7. The glass packaging, which falls freely when it is conveyed over the magnetic drum 7, is fed directly to a crusher 9, where it is disintegrated. The magnetic material is conveyed to the conveyor 10, on which it is conveyed to a mill 11, where it is fragmented. Through the fragmentation operation, non-magnetic components that have been comprised in the original plate packaging, e.g. end parts made of aluminum, are released.

The fragmented material is conveyed by the conveyor 12 over the magnetic drum 13, and the released non-magnetic material is separated from the magnetic material, and collected separately in the containers 16 and 17.

From the foregoing description it is obvious that, by the sorting out and processing of waste material which has been made possible by the present invention, there will be good possiblities of carrying out economic recovery of the waste material. In addition to the fact that waste material of one and the same type can be taken up at the different stations (FIG. 1, parts 4, 5, 16, 17, 18, 19, 20) the quantities of material to be transported are reduced to a great extent through the fragmentation.

Further, it should be understood that the description has been made schematic, for the purpose of concentrating on the most valuable substance of the invention, viz. that it constitutes the principle of an efficient system for sorting and processing solid waste, particularly of the composition which is normal for solid domestic waste.

As an elucidative complement, is should be emphasized that the conveyor 2, FIG. 1, for reasons of principle has been described and shown in FIG. 1 as one single endless conveyor belt. It should be obvious that this conveyor belt, when passing the processing station 3, FIG. 1, and the separating station 4, FIGS. 1 and 5, can very well be divided, to provide for suitable processing of the waste material. This should become still more obvious if consideration is taken of the fact that the processing in the disintegrating unit 3, FIG. 1, appropriately consists of mechanical tearing and cutting operations, combined with jolting, and that the separation in the separating unit 4 is appropriately achieved by means of air jets through freely falling mixed waste. The fibrous organic material which is separated off in the separating unit 4 should appropriately be "spun"

together by being caused to rotate, at which movement accompanying heavier solid particles are separated off by the centrifugal effect.

It should moreover be obvious that the system contains all possibilities of returning material which has not been sufficiently well separated for renewed processing and separation by the system of machinery.

The equipment also contains traps for collecting material that might cause damage to the fragmentation units 9 and 11, e.g. heavier metal objects or stones. The separating stations can all easily be provided with different sieves, in order to ensure that the material which it is desired to obtain is of the right quality.

I claim:

1. An installation for recovering salvagable components from solid compacted waste materials including glass, ferrous metal, aluminum and other non-ferrous metals, organic and non-organic components, said installation comprising:

first magnet means for separating ferrous metal from non-ferrous material;

first crushing means for crushing non-ferrous material;

second crushing means for crushing said ferrous metal;

divider means coacting with the first magnet means for respectively directing non-ferrous material separated at said first magnet means to the first crushing means and ferrous metal separated at said first magnet means to the second crushing means;

separating means coacting with the second crushing means, said separating means including second magnet means for separating additional non-ferrous material from said ferrous metal;

collecting stations for collecting therein sorted-out ferrous metal and non-ferrous materials;

first conveying means for feeding waste to be sorted to the first magnet means;

second conveying means for conveying said ferrous metal to the second crushing means;

third conveying means for conveying ferrous metal crushed in the second crushing means to said second magnet means;

first preparatory means for shredding the compacted waste, said first conveying means conveying the compacted waste to and through said first preparatory means prior to feeding the waste to the first magnet means; and second preparatory means for subjecting waste shredded in the first preparatory means to the action of air jets for blowing lightweight parts from the waste, said first conveying means conveying the waste from the first preparatory means through the second preparatory means to the first magnet means.

2. The installation according to claim 1 and further comprising third preparatory means for subjecting the waste to a washing action for washing out further lightweight parts from the waste, said first conveying means conveying the waste from the second preparatory means to and through the third preparatory means prior to feeding the waste to the first magnet means.

3. An installation for recovering salvagable components from solid compacted waste materials including glass, ferrous metal, aluminum and other non-ferrous metals, organic and non-organic components, said installation comprising:

a first magnet means for separating ferrous metal from non-ferrous material;

first crushing means for crushing non-ferrous material;

second crushing means for crushing ferrous metal;

divider means coacting with the first magnet means for respectively directing non-ferrous material separated at said first magnet means to the first crushing means and ferrous metal separated at said first magnet means to the second crushing means;

first separating means coacting with the first crushing means for sorting crushed non-ferrous materials;

second separating means coacting with the second crushing means, said second separating means including second magnet means for separating additional non-ferrous material from said ferrous metal;

collecting stations for collecting therein sorted-out ferrous metal and non-ferrous materials;

first conveying means for feeding waste to be sorted to the first magnet means;

second conveying means for conveying ferrous from the first magnet means to the second crushing means;

third conveying means for conveying ferrous metal crushed in the second crushing means to the second magnet means;

first preparatory means for shredding the compacted waste, said first conveying means conveying the compacted waste to and through said first preparatory means prior to feeding the waste to the first magnet means; and second preparatory means for subjecting waste shredded in the first preparatory means to the action of air jets for blowing lightweight parts from the waste, said first conveying means conveying the waste from the first preparatory means through the second preparatory means to the first magnet means.

4. The installation according to claim 3 and further comprising third preparatory means for subjecting the waste to a washing action for washing out further lightweight parts from the waste, said first conveying means conveying the waste from the second preparatory means to and through the third preparatory means prior to feeding the waste to the first magnet means.

* * * * *